United States Patent [19]

Eggert, Jr.

[11] 4,355,583

[45] Oct. 26, 1982

[54] SIDE BEARING FOR A RAILWAY CAR

[75] Inventor: Walter S. Eggert, Jr., Huntington Valley, Pa.

[73] Assignee: The Budd Company, Troy, Mich.

[21] Appl. No.: 206,305

[22] Filed: Nov. 12, 1980

[51] Int. Cl.[3] ..... B61F 5/014

[52] U.S. Cl. ..... 105/199 CB; 267/3; 267/6; 267/21 R; 267/141; 308/26; 308/138

[58] Field of Search ..... 105/199 R, 199 A, 199 C, 105/199 CB, 199 F, 199 S, 200, 452, 182 R; 308/138, 140, 143, 152, 160, 26; 267/6, 21 R, 141, 141.1, 3

[56] References Cited

U.S. PATENT DOCUMENTS

| | | | |
|---|---|---|---|
| 1,660,676 | 2/1928 | Josephs, Jr. | 105/199 CX |
| 2,301,372 | 11/1942 | Cottrell | 308/138 |
| 2,908,230 | 10/1959 | Dean | 105/182 R |
| 3,363,870 | 1/1968 | Olson | 267/141 X |
| 4,240,676 | 12/1980 | Anderson et al. | 308/160 X |

FOREIGN PATENT DOCUMENTS

| | | | |
|---|---|---|---|
| 103182 | 2/1938 | Australia | 267/141.1 |

*Primary Examiner*—Joseph F. Peters, Jr.
*Assistant Examiner*—M. J. Hill
*Attorney, Agent, or Firm*—A. L. Trufax, Jr.

[57] ABSTRACT

A side bearing comprises integrally bonded pieces including an elastomeric cushion member secured to top and bottom plates and flexible leveling means secured to the bottom plate. The bearing is designed for connection between the bolster and truck side frames of a railway car. The elastomeric member includes progressively larger openings therein extending from its center to its ends to provide varying flexibility to permit articulation of the truck side frames relative to the bolster during operation.

6 Claims, 10 Drawing Figures

FIG. 1
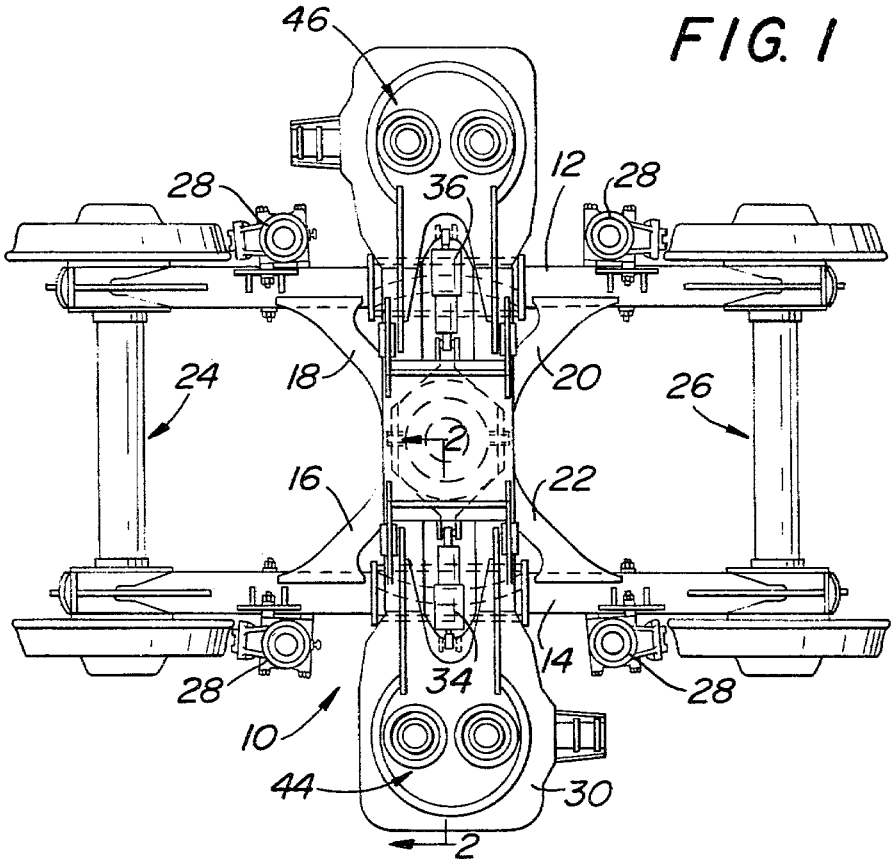
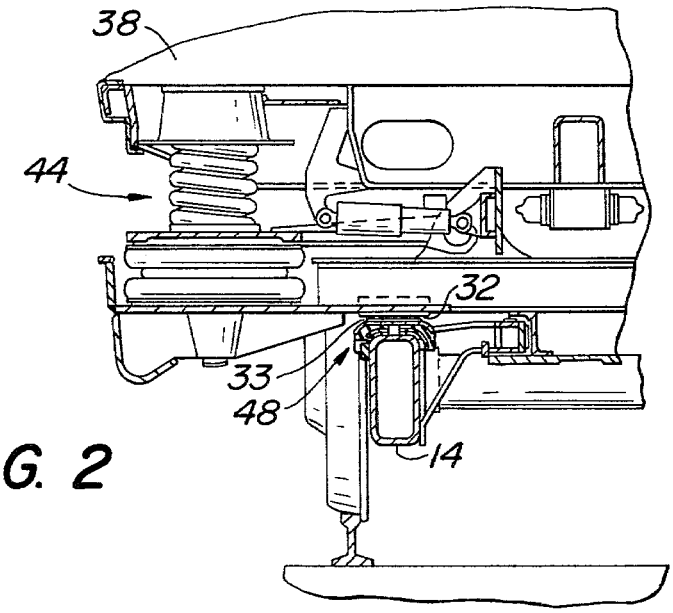
FIG. 2

FIG. 3
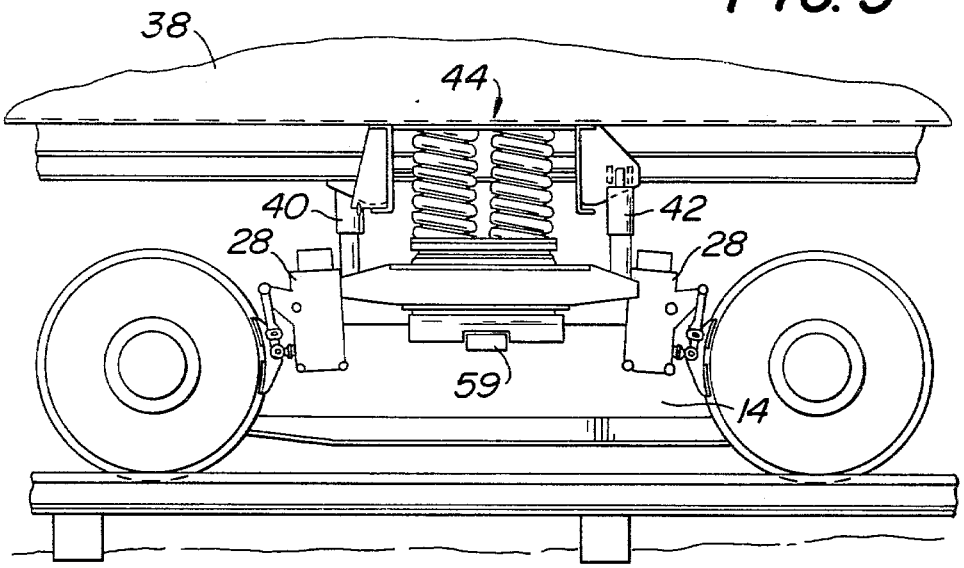
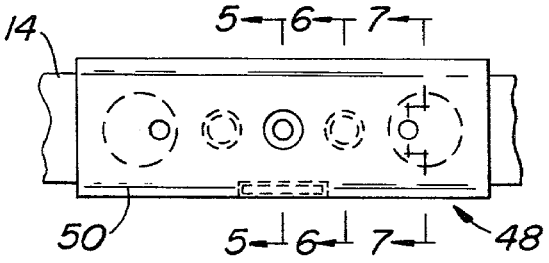
FIG. 4
FIG. 9
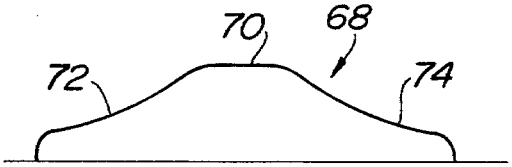
FIG. 10
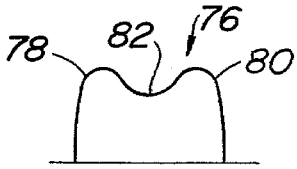

SIDE BEARING FOR A RAILWAY CAR

BACKGROUND OF THE INVENTION

In railway cars, it is conventional to have a car body connected through suitable springs to a bolster. The bolster in turn is connected to side frames of the truck. Side bearings are normally connected between the bolster and the side frames.

The side bearings generally comprise elastomeric members to provide some degrees of relative movements between the bolster which supports the car body and the side frames of the truck. Heretofore, the side bearings have been of constant thicknesses throughout their lengths and provide uniform flexibility throughout. The relatively uniform flexibility tends to prevent pivoting of the car body with respect to the truck.

Also, side bearings used heretofore have involved a cushion flexible member connected between top and bottom plates. The cushion member is generally loosely connected between the plates. As a result, the flexible member, generally made of rubber, tends to stretch or extrude out of the edges of the plates. Because of the relative movement of the cushion with respect to the plates, the stress level at which the rubber may be worked is lowered. Also, excess wear results.

OBJECTS OF THE INVENTION

It is an object of this invention to provide an improved side bearing for a railway car.

It is a further object of this invention to provide an improved side bearing assembly which may be used at higher stress levels than similar type assemblies used heretofore.

It is a further object of this invention to provide an improved side bearing for a railway car in which the flexibility of the bearing is improved to permit improved articulation between the bolster and the truck.

BRIEF SUMMARY OF THE INVENTION

In accordance with the present invention, an integral side bearing assembly is adapted to be connected between the bolster and side frame of a railway car. The side bearing comprises molded or bonded top and bottom plate members secured to a flexible member with a flexible leveling strip or element being secured to the bottom plate member. The flexible or elastomeric member between the plates include a plurality of openings therein extending in opposite directions and becoming progressively larger as they extend from the center of the flexible member. The progressively larger openings provide greater flexibility away from the center of the bearing to permit some pivoting of the bolster with respect to the side frame and truck and better articulation therebetween.

Other objects and advantages of the present invention will be apparent and suggest themselves to those skilled in the art, from a reading of the following specification and claims, taken in conjunction with the accompanying drawings.

DESCRIPTION OF THE DRAWINGS

FIG. 1 is a top view of a typical truck, in which the side bearing of the present invention may be employed;

FIG. 2 is a cross-sectional view taken along lines 2—2 of FIG. 1;

FIG. 3 is a side view of the truck illustrated in FIG. 1 supporting a car body;

FIG. 4 is a top view of a side bearing, in accordance with the present invention which may be used with a type of railway car illustrated in FIGS. 1, 2 and 3;

FIG. 9 is a curve illustrating the longitudinal load deflection characteristic response of the side bearing of FIG. 4; and FIG. 10 is a curve illustrating the lateral load deflection characteristic response of the side bearing of FIG. 4.

DESCRIPTION OF THE INVENTION

Figure 5:
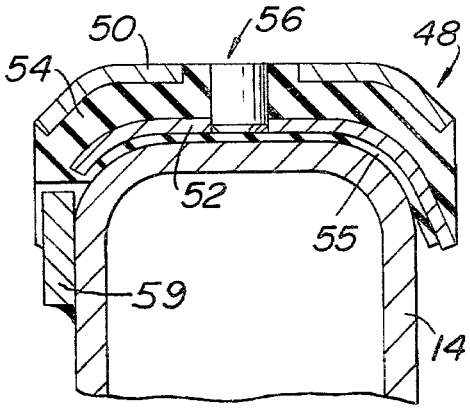
FIG. 5 is a cross-sectional view taken along lines 5—5 of FIG. 4.
Figure 6:
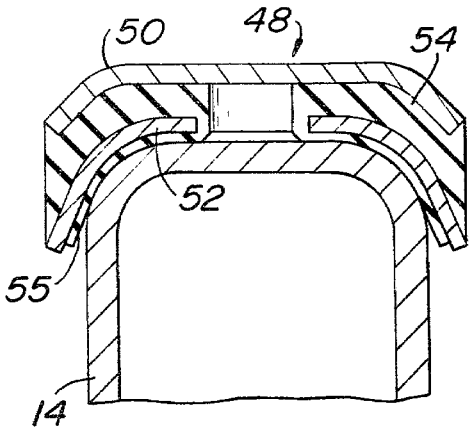
FIG. 6 is a cross-sectional view taken along lines 6—6 of FIG. 4.

Referring to FIGS. 1, 2 and 3, a typical truck 10 for a railway car is illustrated. Many of the features illustrated are used in conventional trucks and are shown merely to illustrate one type of truck with which the side bearings of the present invention may be used.

The truck 10 includes a pair of side frames 12 and 14 having a spider like frame or structure extending therefrom including arms 16, 18, 20 and 22. Wheel-axle units 24 and 26 are suitably mounted in bearings disposed at the ends of the side frames 12 and 14. Brake units 28 are mounted outboard and disposed to engage the wheels of the wheel-axle units during a braking operation.

A bolster 30 is supported transversely on the side frames 12 and 14. A pair of slide bearings, such as slide bearing 32 illustrated in FIG. 2, are disposed between the bolster 30 and wear plates, such as the wear plate 33, connected to the side frames through the side bearings of a type involving the present invention which will be more clearly illustrated and described in connection with the subsequent FIGS. 4–8. The side bearings, one such side bearing 48 being illustrated, permit the bolster 30 to be articulated with respect to the truck side frames 12 and 14.

Transverse or lateral shock absorbers 34 and 36 are connected between the car body 38 and the bolster 30. Vertical shock absorbers 40 and 42 are also connected between the car body 38 and bolster 30. The car body 38 is supported on the bolster 30 by a pair of spring suspension arrangements 44 and 46. Each of the spring arrangements may include a pair of mechanical springs and an air spring.

The present invention is directed to the side bearing assemblies, such as the side bearing assembly 48, disposed between the bolster 30 and the side frames 12 and 14. The assembly 48 is illustrated in FIG. 2, with enlarged details thereof being illustrated in subsequent FIGS. 4–8.

The side bearing 48 comprises an integral unit with the pieces therein being bonded together by suitable means or methods. The bearing 48 may be formed in or molded with a flexible rubber cushion and bottom flexible strip being secured to a pair of plates by vulcanization or the like.

Referring to FIGS. 4–8, the integral side bearing assembly 48 comprises a top plate 50 and a bottom plate 52 with an elastomeric cushion member 54, which may be rubber, disposed therebetween. A flexible surface strip 55, which may be rubber, is secured to the bottom of bottom plate 52. This element 55 provides levelling and provides tolerances for slight changes in dimensions between the side bearing and side frame. The strip 55 may be integral with the member 54, be of the same material and molded at the same time.

Figure 7:
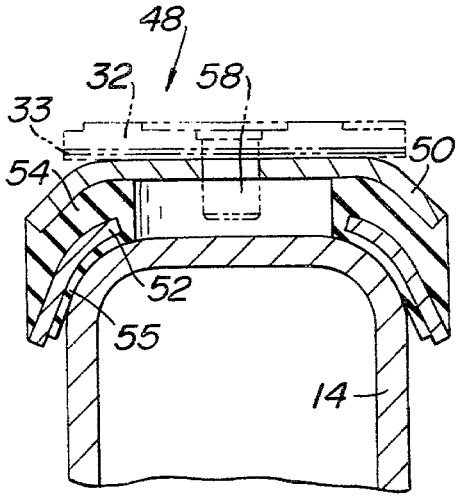
FIG. 7 is a cross-sectional view taken along lines 7—7 of FIG. 4.

As illustrated in FIG. 5, plates 50, 52 and cushion member 54 include a central opening 56. This opening 56 is dimensioned to receive a fail safe pin 58 from the bolster (FIG. 7). The pin 58 holds all the elements in place in the event that the bond between the various elements is broken and tends to separate. The side bearing assembly 48 extends longitudinally along the side frame 14. The assembly 48 includes a rectangular cutaway area 57 dimensioned to receive a protruding member 59 (FIG. 3) which is connected to the side frame to prevent longitudinal movement of the bearing 48 on the side frame.

Figure 8:
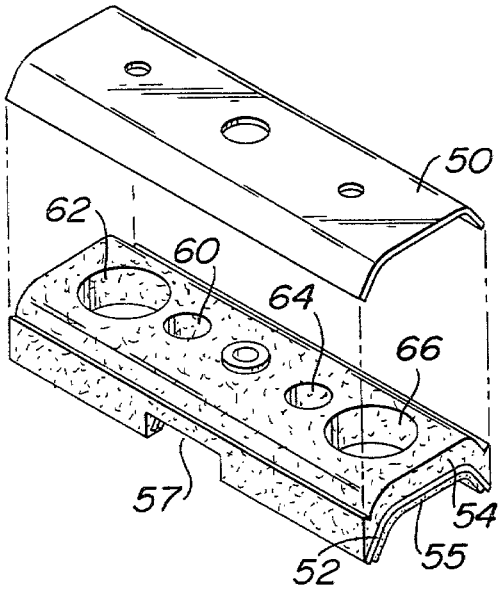
FIG. 8 is an isometric exploded view of the side bearing assembly of FIG. 4.

The cushion member 54 comprises an elastomeric material to provide articulation between the bolster 30 and truck during operation. As illustrated in FIG. 8, a plurality of openings 60, 62, 64 and 66 extend through the side bearing cushion member 54. The openings 60 and 62 increase in size as they extend from the center along the longitudinal axis of the cushion member 54. In like manner, the sizes of the openings 64 and 66, in alignment with the openings 60 and 62, progressively increase as they extend away from the center of the cushion member 54 in an opposite direction to the openings 60 and 62.

The center portion of the elastomeric member 54, not having an open area therein, represents a relatively high pressure zone with low flexibility. As the openings 60 and 64 are approached, the cushion 54 becomes more flexible or represents a low pressure zone. Towards the ends of the cushion 54 in the areas of the openings 62 and 66, the cushion exhibits a still greater degree of flexibility and lower pressure zone because of the larger openings involved. Thus, the cushion 54 displays a variable flexibility or resistance as it extends from its center towards its two ends.

Referring to FIG. 9, a deflection curve 68 illustrates generally the relative stiffness or resistance of the cushion member 54 in a longitudinal direction, this being the reciprocal of the flexibility involved. The center or peak portion 70 of the curve represents the resistance at the center of the cushion indicative of high stiffness and low flexibility and low deflection property at the center of the cushion. The portions of the curve 72 and 74 illustrates relatively low stiffness or high flexibility or deflection characteristic as the ends of the cushion 54 are approached away from the center. The reason for the low stiffness and high flexibility is the presence of the openings 60, 62, 64 and 66 in the side bearing cushion 54. The curve 68 illustrates generally the variable flexibility and deflection properties at different areas in the cushion. The overall effect is that a bolster resting on the side bearing cushion 54 will pivot about the center of the side bearing. Thus the bolster will pivot longitudinally with respect to the truck.

Referring to FIG. 10, a deflection curve 76 shows two peak sections 78 and 80 with a valley or depression portion 82 therebetween. This curve represents resistance to deflections of the cushion 54 in a lateral direction. It is seen that the cushion 54 has resistance and deflection properties or low flexibility along its outer edges and low resistance or high flexibility along its longitudinal axis. The reason for the dip or valley 82 in the curve is the presence of the openings 60, 62, 64 and 66 along the axis of the side bearing cushion 54.

The overall variable rates of deflections provide improved articulation between the bolster and the truck. The integral side bearing makes the rubber between the plates better able to withstand higher stresses because the rubber cushion does not extrude, the wearing of the rubber cushion is reduced. The overall result is a more durable side bearing with improved articulation between the bolster and truck.

What is claimed is:

1. In combination with a car body carried by a bolster supported on a pair of side frames, an integral bearing assembly disposed between said bolster and each of said side frames, comprising:

(a) top and bottom plate members extending along each of said side frames;

(b) an elastomeric cushion member disposed between said top and bottom plate members;

(c) an elastomeric strip secured to said bottom plate members between said bottom plate and said associated bolster;

(d) said elastomeric member including a plurality of openings therein; and (e) said openings extending in opposite directions and becoming progressively larger as they extend from the center of said side bearing.

2. The combination as set forth in claim 1 wherein said side bearing assembly comprises a molded piece with said elastomeric cushion and strip comprising vulcanized rubber.

3. The combination as set forth in claim 2 wherein said side bearing assembly includes a rectangular cutaway area dimensioned to receive a protruding member connected to each of said side frames.

4. The combination as set forth in claim 3 wherein said plurality of openings extend along the longitudinal axis of said side bearing assembly.

5. The combination as set forth in claim 4 wherein said plurality of openings comprise two pairs of progressively larger openings extending in opposite directions from the center of said side bearing assembly.

6. The combination as set forth in claim 5 wherein said top plate member and said elastomeric cushion includes a central opening from receiving a fail safe pin secured to said bolster.

* * * * *

UNITED STATES PATENT AND TRADEMARK OFFICE

CERTIFICATE OF CORRECTION

PATENT NO. : 4,355,583

DATED : October 26, 1982

INVENTOR(S) : Walter S. Eggert, Jr.

It is certified that error appears in the above-identified patent and that said Letters Patent is hereby corrected as shown below:

Col. 4, line 32, "bolster" should be --side frames--

Signed and Sealed this

First Day of October 1985

[SEAL]

*Attest:*

DONALD J. QUIGG

*Attesting Officer*

*Commissioner of Patents and Trademarks—Designate*